US005540179A

United States Patent [19]

Mayfield

[11] Patent Number: 5,540,179

[45] Date of Patent: Jul. 30, 1996

[54] BUOYANCY CONTROLLED APERTURE FOR A FLOTATION DEVICE

[76] Inventor: Daniel R. Mayfield, P.O. Box 114, Moxee, Wash. 98936

[21] Appl. No.: 536,423

[22] Filed: Sep. 29, 1995

Related U.S. Application Data

[62] Division of Ser. No. 366,688, Dec. 30, 1994.

[51] Int. Cl.[6] ..... B63B 17/00

[52] U.S. Cl. ..... 114/362

[58] Field of Search ..... 441/35, 40; 114/343, 114/345, 346, 351, 362, 121

[56] References Cited

U.S. PATENT DOCUMENTS

| | | | |
|---|---|---|---|
| 3,797,440 | 3/1974 | Pangalila | 114/125 |
| 4,276,849 | 7/1981 | Bloxham | 114/125 |

*Primary Examiner*—Stephen Avila
*Attorney, Agent, or Firm*—Stratton Ballew PLLC

[57] ABSTRACT

The invention is a buoyancy activated barrier for opening an closing an aperture defined in the stern of a sportsman's flotation device which permits the user to easily and quickly enter and exit the flotation device. The barrier is slidably mounted in the aperture of the flotation device such that it is free to establish its own level of equilibrium in the water, thereby defining its own waterline. When the user wishes to enter the flotation device, it is unloaded, and the upper surface of the barrier is spaced relatively below the top surface of the flotation device, providing an easy passageway for the user. When the user sits in the flotation device, loading it, the upper surface of the barrier becomes level with the upper surface of the flotation device, closing the aperture, to provide a protected, confined space for the user. When the user wishes to exit the flotation device, she simply stands up in shallow water, thus unloading the flotation device. Again, the upper surface of the barrier is displaced below the upper surface of the flotation device, opening the aperture for easy exit. Interchangeable barriers for modifying the shape or configuration of the device may be configured to act as the buoyancy activated barrier.

8 Claims, 20 Drawing Sheets

BUOYANCY CONTROLLED APERTURE FOR A FLOTATION DEVICE

CROSS REFERENCE TO RELATED APPLICATION

This application is a divisional of U.S. patent application Ser. No. 08/366,688 filed Dec. 30, 1994 in the name of Daniel R. Mayfield for a Personal Flotation/Transportation Device which is currently pending.

TECHNICAL FIELD

This invention relates to personal flotation devices used in activities such as hunting and fishing. More specifically, the invention relates to a device whereby an aperture in a flotation device may be opened or closed by a buoyant barrier in response to the position of the aperture relative to the water.

BACKGROUND OF THE INVENTION

In the sports of fishing and waterfowl hunting, a need has long existed for a means of moving the sportsman and his gear across the water. Boats, canoes, and rafts, have all been used with varying degrees of success. More recently, personal flotation devices have been provided for supporting the sportsman and his gear while moving about a lake or other body of water. These tend to be kick-powered devices. The devices such far have been comprised of at least one inflatable tube along with some structure for supporting the user in a seated or reclined position. The tubes have taken a variety of shapes and sizes, each shape offering different advantages.

The flotation devices currently available are not designed for easy and rapid entry and exit by the user. Entering and exiting is particularly difficult in kick-powered craft, where the user is seated low with respect to the surface of the water, with her legs extending through an opening in the craft. In addition to not being convenient to enter and exit, the current designs present serious safety issues. The inability to rapidly exit the device can cause the user to drown in a variety of scenarios. This is particularly a problem where the user is weighted down with various items of sports gear, such a waders and tackle. Waders present a significant danger since they are susceptible to being punctured and filing with water, making it difficult to remain afloat.

SUMMARY OF THE INVENTION

The invention is specifically intended to be used as part of a sportsman's flotation device having a hull including a bow, stern and a full keel, a seat disposed within the keel and an opening defined in the device for receiving the sportsman's legs therethrough for propelling and directing the device. The device includes a buoyancy activated barrier for opening and closing an aperture defined in the stern of the hull which permits the user to easily and quickly enter and exit the flotation device.

The flotation device has an unloaded waterline that is level with the surface of the water when the flotation device sits in the water while unloaded and a loaded waterline that is level with the surface of the water when the flotation device sits in the water while loaded. The loaded waterline is spaced relatively above the unloaded waterline. The barrier is slidably mounted in the aperture such that it is free to establish its own level of equilibrium in the water, thereby defining its own waterline.

When the flotation device is loaded, its loaded waterline will be level with the surface of the water. Since the barrier's waterline is always level with the surface of the water, the barrier's waterline and the flotation device's loaded water line will be level with one another when the flotation device is loaded.

When the flotation device is unloaded, its unloaded waterline will be level with the surface of the water. Since the barrier's waterline is always level with the surface of the water, the waterline of the barrier will be level with the flotation device's unloaded waterline when the flotation device is unloaded.

The loading and unloading of the flotation device produces the appearance of the barrier sliding open, when the device is unloaded, and sliding closed, when the device is loaded. In fact, the barrier remains fixed relative to the surface of the water and the flotation device is moving.

When the user wishes to enter the flotation device, the device being unloaded, the upper surface of the barrier is spaced relatively below the top surface of the flotation device, providing an easy pathway in for the user. When the user sits in the flotation device, loading the device, the upper surface of the barrier becomes level with the upper surface of the flotation device, closing the aperture, to provide a protected and confined space for the user. When the user wishes to exit the flotation device, she simply stands up, in shallow water, thus unloading the flotation device. Again, the upper surface of the barrier is displaced below the upper surface of the flotation device, opening the aperture for easy exit.

The buoyancy activated barrier can be configured as an interchangeable barrier, or stern adapter, for modifying the shape or configuration of the flotation device.

It is an object of the present invention to provide a personal flotation device which can be readily entered and exited by the user, without the need for struggling over the side of the hull.

These and other objectives will become clear in the description which follows.

BEST MODE OF CARRYING OUT THE INVENTION

Figure 1A:
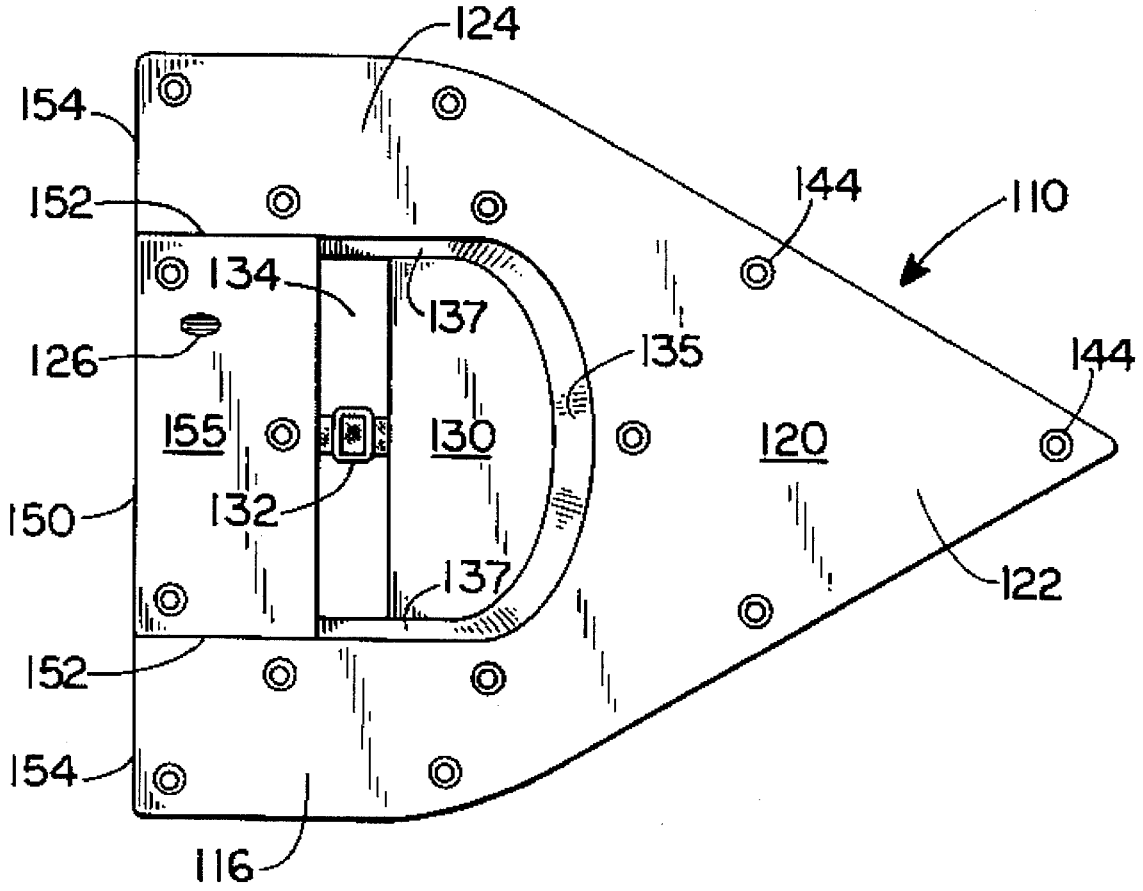
FIG. 1A is a top plan view of the first preferred embodiment of the invention, showing a removable rectangular barrier.

FIGS. 1A–1G, 2 and 3 show a first preferred embodiment of the invention comprising a flotation device 110 having a hull 116 with a bow 122 and a stern 124, a substantially horizontal upper surface 120, a curved lower surface 180, a full keel shown generally as 160, an aperture 157 defined in the hull 116 preferably through the transom 154 at the stern 124, and a barrier 150. The keel has a curved side surface 162, adjacent the lower surface 180, and a substantially horizontal bottom surface 164.

In this embodiment, a rectangular buoyant barrier 150 is slidably mounted in the aperture 157 in hull 116. The aperture 157 provides a convenient way for a user to enter and exit the flotation device 110, without having to struggle over the hull 116.

Rather than use a daggerboard, centerboard or a fin keel, the flotation device 110 is preferably designed with a full keel 160. The keel 160 has a curved side surface 162 adjacent lower surface 180, and a substantially horizontal bottom surface 164. A cavity is formed between the curved side surface 162, which provides space in which the user may be seated. The use of a full keel 160 provides two benefits: 1) the keel aids tracking, especially when a cross-wind is encountered; and 2) the user, seated in the keel 160 acts as ballast, adding stability to the craft's design. Full keels 160 to date have only been associated with large sailboats, to provide lateral resistance against the force created by wind in the sails. The ballast traditionally associated with a full keel 160 is a metal such as lead, or stone. Since a keel 160 of any type tends to reduce the draft, prior art has suggested that keels 160 be left out of small craft such as canoes, kayaks, row boats, dinghies, and float tubes.

Figure 2:
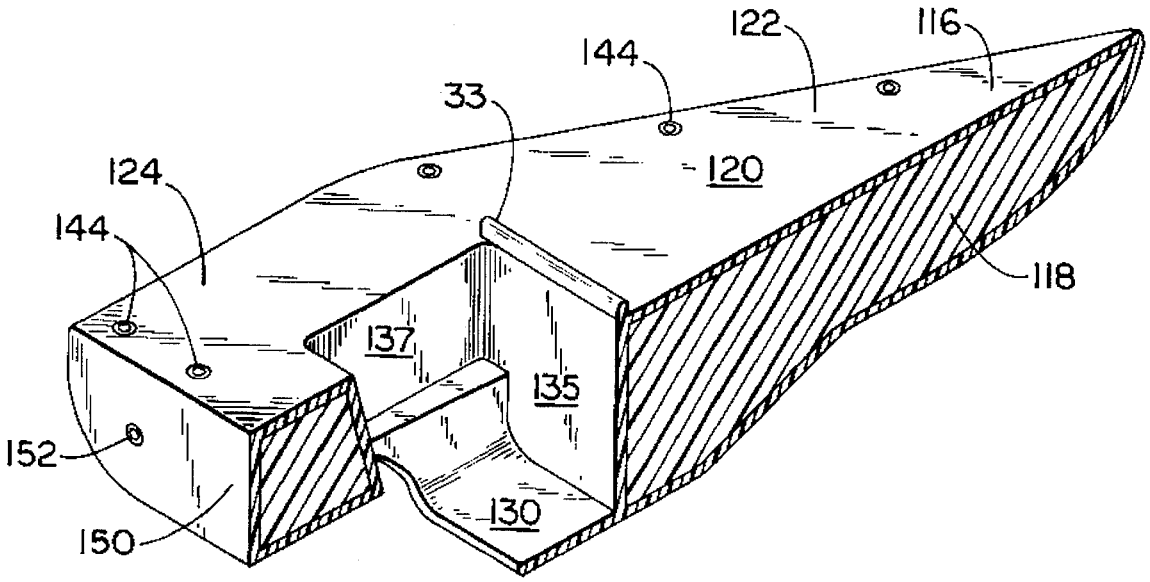
FIG. 2 is a sectional view taken along the centerline of the first preferred embodiment of the invention.

With specific reference to the sectional view of FIG. 2, the hull 116 is filled with a buoyant material 118. Applicant has had success using an aerosol expanding foam, but other kinds of low density foam are contemplated for providing buoyancy. Alternatively, the hull may be made of a buoyant material.

Figure 1B:
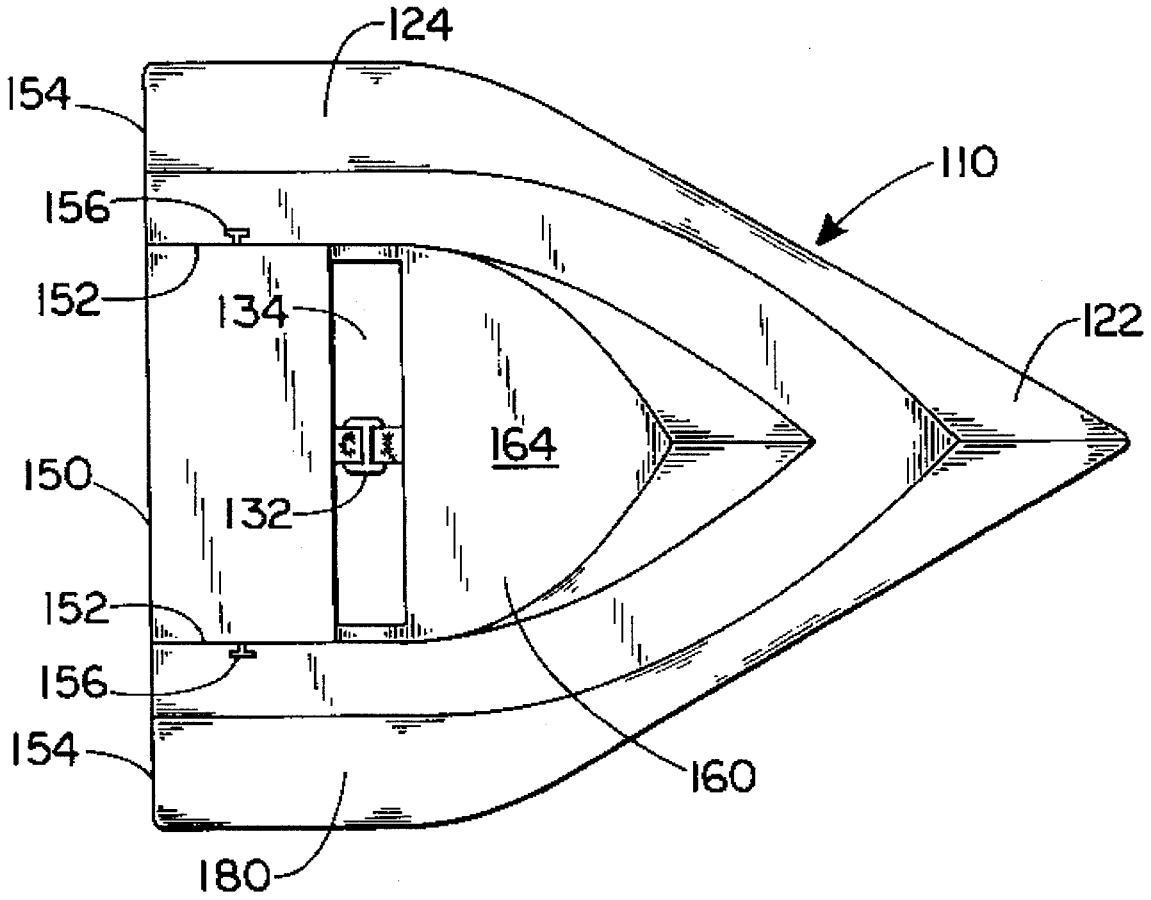
FIG. 1B is a bottom plan view of the first preferred embodiment of the invention, showing a removable rectangular barrier.
Figure 1C:
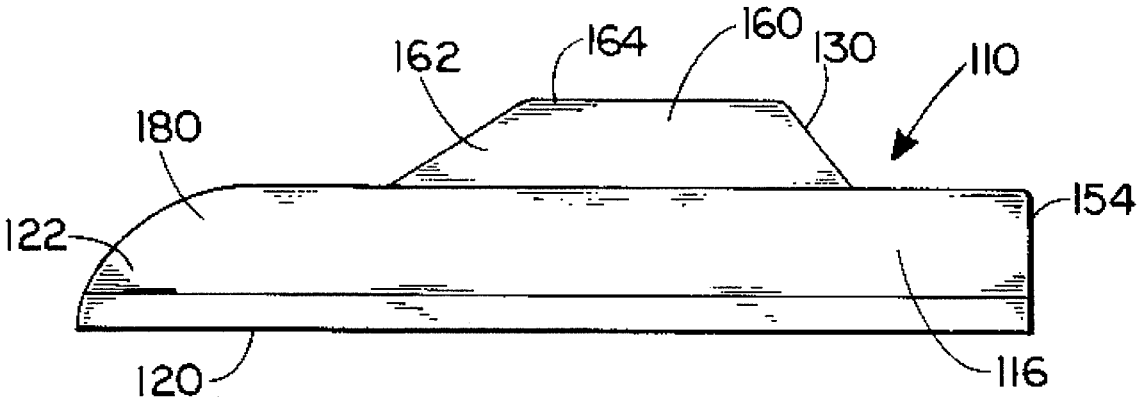
FIG. 1C is a side plan view of the first preferred embodiment of the invention.

With specific reference to FIGS. 1A and 1C, an opening 134 is defined through the hull 116. Below the upper surface 120 is a seating means for supporting the user, comprising a curved seat 130, a substantially vertical backrest 135, and side walls 137. A safety strap 132 is secured to the front edge of seat 130, and extends across opening 134 to a substantially rectangular stern 150 having a transom 154.

Figure 3:
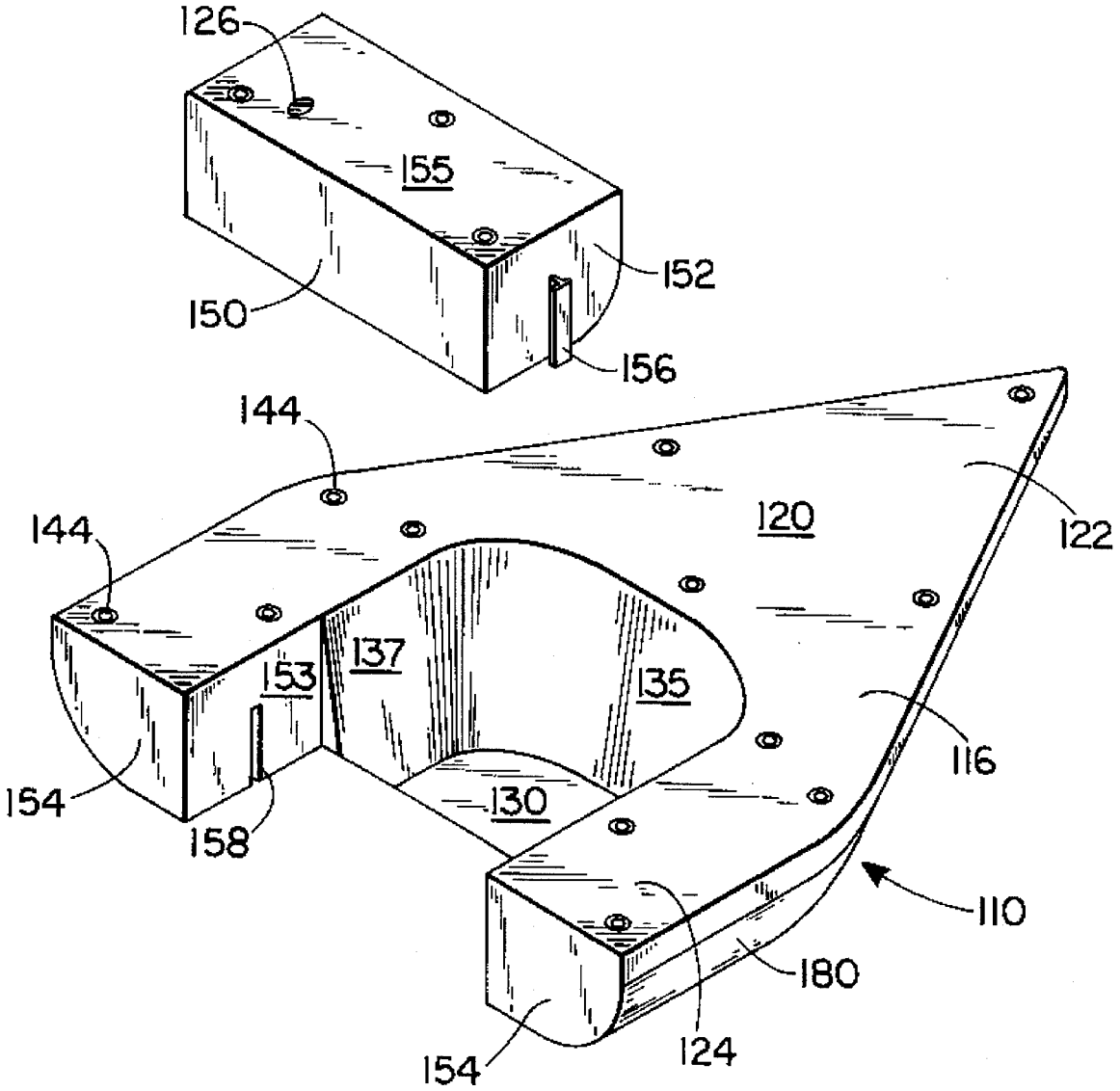
FIG. 3 is a perspective view of the second preferred embodiment of the invention, showing the rectangular barrier removed from the body.

With specific reference to FIG. 3, the barrier 150 has two ends 152 which are substantially perpendicular to its upper surface 155. The flotation device 110 slidably receives the barrier 150 into the aperture 157 by sliding the T-shaped flanges 156 located on ends 152 into the T-shaped channel 158 located on inside walls 153 of the flotation device 110. Inside walls 153 are substantially perpendicular to upper surface 120 of flotation device 110, and complementary to the angle of ends 152 of barrier 150, such that when the barrier 150 is installed in the flotation device 110, ends 152 are substantially adjacent to respective inside walls 153. Upper surface 155 of the barrier 150 is substantially horizontal.

Figure 1D:
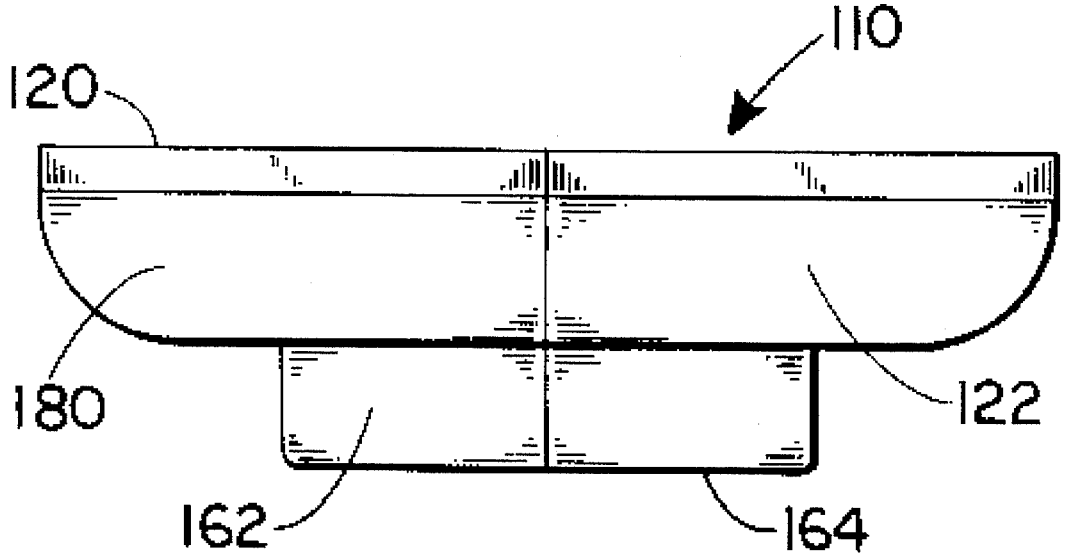
FIG. 1D is a front plan view of the first preferred embodiment of the invention.
Figure 1E:
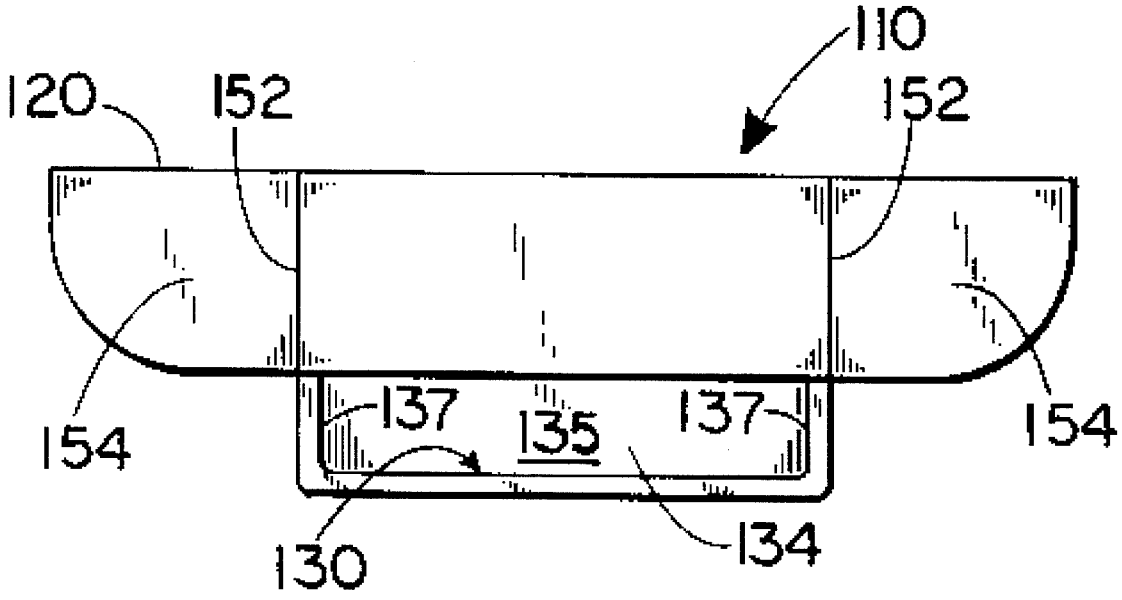
FIG. 1E is a back plan view of the first preferred embodiment of the invention.
Figure 1F:
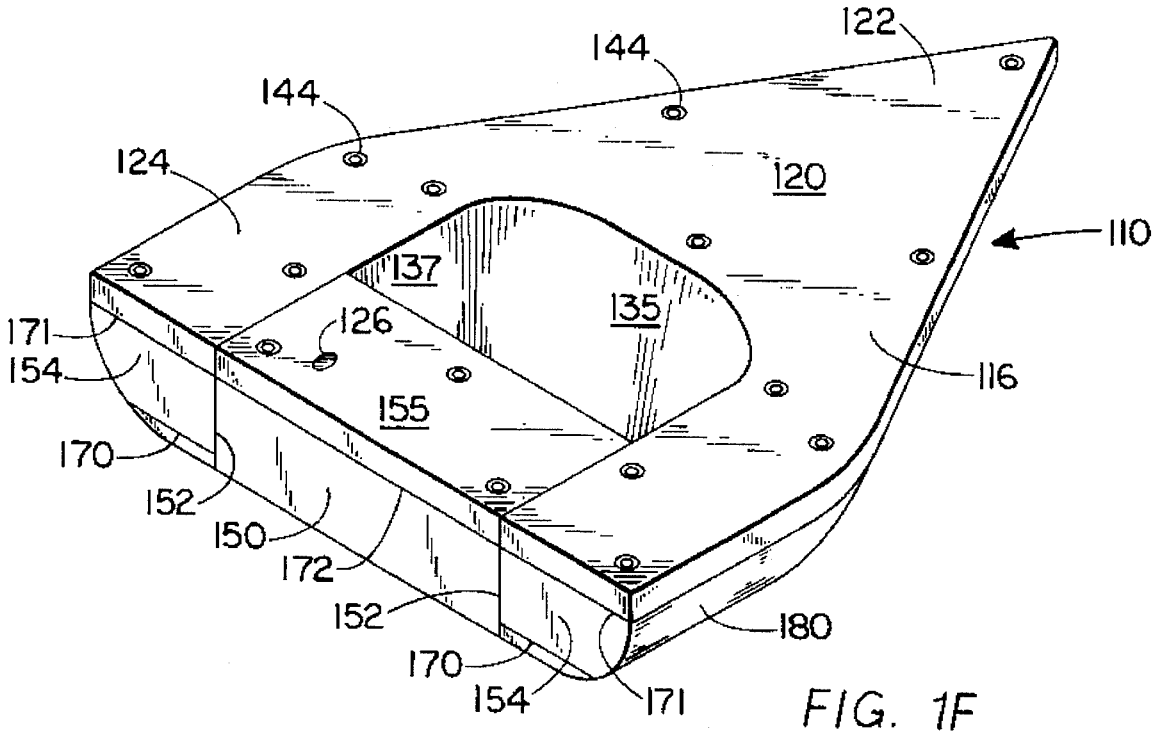
FIG. 1F is a perspective view of the first preferred embodiment of the invention, showing a removable rectangular barrier in the closed position.
Figure 1G:
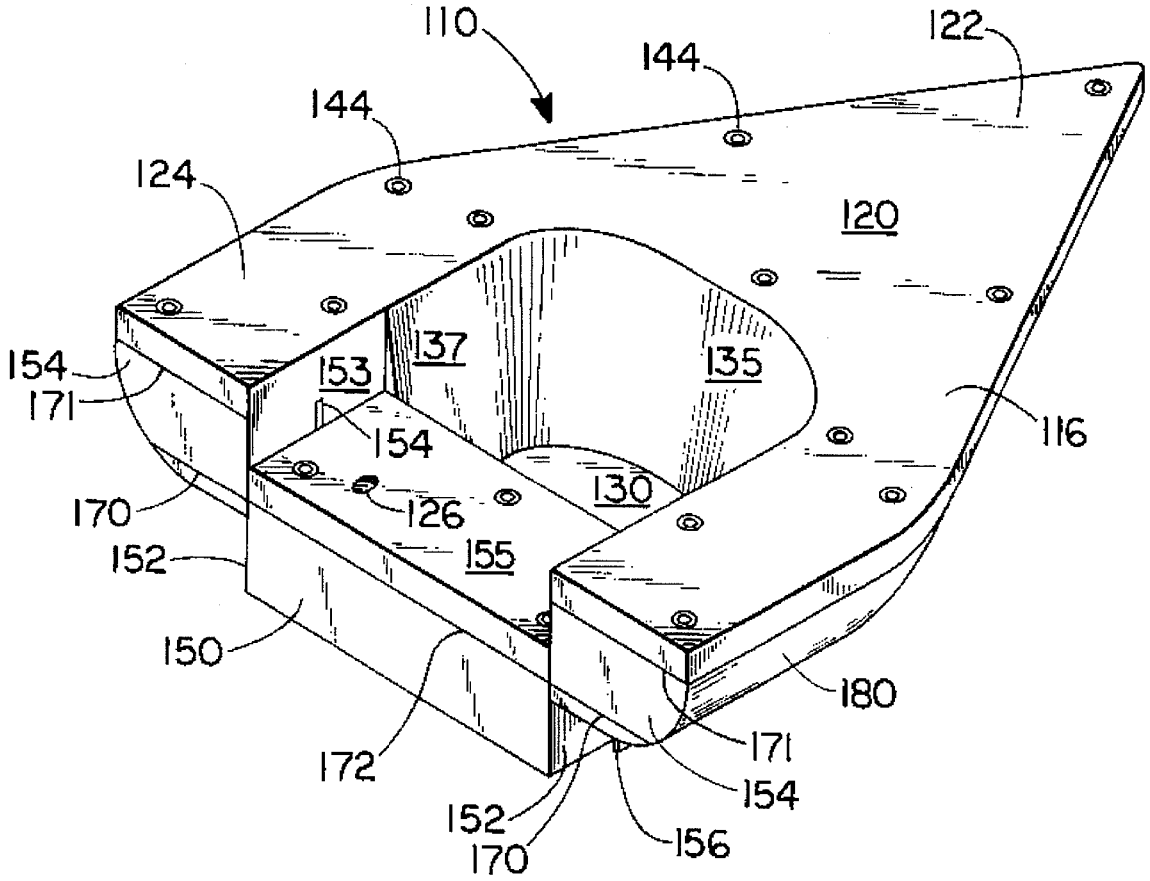
FIG. 1G is a perspective view of the first preferred embodiment of the invention, showing a removable rectangular barrier in the open position.

With particular reference to FIGS. 1F and 1G, the flotation device 110, like all waterborne craft has a pair of waterlines. The unloaded waterline 171 is the line about the hull 116 that would be level with the surface of the water when the flotation device 110 sits in the water unloaded. The loaded waterline 171 is the line about the hull 116 that would be level with the surface of the water when the flotation device 110 sits in the water loaded. The loaded waterline 171 is of course dependent on the weight of the load, however for our purposes we assume the load to be the weight of the average user, 160 pounds. The loaded waterline 171 is spaced relatively above the unloaded waterline 171.

Since the barrier 150 is slidably mounted in the aperture 157, it is free to establish its own level of equilibrium in the water, thereby defining its own waterline 172, only constrained by the distance the barrier 150 is permitted to slide relative to the flotation device 110. In the preferred embodiment, the barrier 150 is permitted to slide such that its waterline 172 is always level with the surface of the water.

When the flotation device 110 is loaded, its loaded waterline 171 will be level with the surface of the water. Since the barrier's waterline 172 is always level with the surface of the water, the barrier's waterline 172 and the flotation device's loaded water line 171 will be level with one another when the flotation device 110 is loaded. The dimensions of the barrier 150 may be set, such that the upper surface of the barrier 155 is even with the upper surface of the flotation device 120 at the stern 124.

When the flotation device 110 is unloaded, its unloaded waterline 170 will be level with the surface of the water. Since the barrier's waterline 172 is always level with the surface of the water, the waterline of the barrier 172 will be level with the flotation device's unloaded waterline 170 when the flotation device 110 is unloaded.

The loading and unloading of the flotation device 110 gives that appearance of the barrier sliding open, when the device 110 is unloaded, and closed, when the device 110 is loaded. In fact, the barrier 150 remains fixed relative to the surface of the water and it is the flotation device 110 that is moving relative to the water.

When the user wishes to enter the flotation device, it is unloaded, and the upper surface of the barrier 155 is spaced relatively below the top surface of the flotation device 120, providing an easy pathway in for the user. When the user sits in the flotation device 110, loading it, the upper surface of the barrier 155 becomes level with the upper surface of the flotation device 120, closing the aperture 157, to provide a protected, confined space for the user. When the user wishes to exit the flotation device 110, she simply stands up, in shallow water, thus unloading the flotation device 110. Again, the upper surface of the barrier 155 is displaced below the upper surface of the flotation device 120, opening the aperture 157 for easy exit.

Preferably a receptacle 126 is provided on the barrier 150 for receiving the handle of a fishing rod (not shown).

With reference to FIGS. 1A and 1C, an opening 134 is defined through the hull 116. Below the upper surface 120 is a seating means for supporting the user, comprising a curved seat 130, a substantially vertical backrest 135, and side walls 137.

A plurality of attachment means 144 are situated about the perimeter of the upper surface 120 of hull 116. The attachment means 144 are used to secure interchangeable accessories (not shown) to the flotation device 110.

The bottom of the flotation device is shown in FIGS. 1B and 1C. The underside 180 curves downward from upper surface 120, forming an apex at the distal end of the bow 122. Full keel 160 projects downward from lower surface 180. Opening 134 in hull 116 is situated between the substantially horizontal bottom surface 164 of the keel 160, and the barrier 150.

FIG. 1D depicts the flotation device as viewed from the bow end. FIG. 1E depicts the flotation device as viewed from the stern end. Seat back 135 is shown as viewed through opening 134 in the hull 116.

FIGS. 1F and 1G are a perspective views of the flotation device described in FIGS. 1A–1E, with the buoyancy activated aperture in the closed and the open positions, respectively.

FIGS. 4A, 4B, 4C, 4D, 4E, 4F and 5 show a second preferred embodiment, comprising a flotation device 210 having a hull 216 with a bow 222 and a stern 224, a substantially horizontal upper surface 220, a curved lower surface 280, and a full keel shown generally as 260. The keel has a curved side surface 262, adjacent the lower surface 280, and a substantially horizontal bottom surface 264. In this embodiment, a substantially T-shaped barrier 250 is inserted in the aperture 257 in the stern 224. The T-shaped barrier adapter 250 is slidingly mounted to the flotation device 210 as described above and acts as a stern adapter for modifying the shape of the flotation device 210.

The barrier 250 allows the shape and configuration of the flotation device 210 to be easily changed to suit the user, activity or body of water. Barriers 250 of various shapes may be provided. Additionally, various types of attachment means and concavities may be provided on different barriers 250.

Preferably a receptacle 226 is provided on rectangular barrier 250 for receiving the handle of a fishing rod (not shown).

Figure 4A:
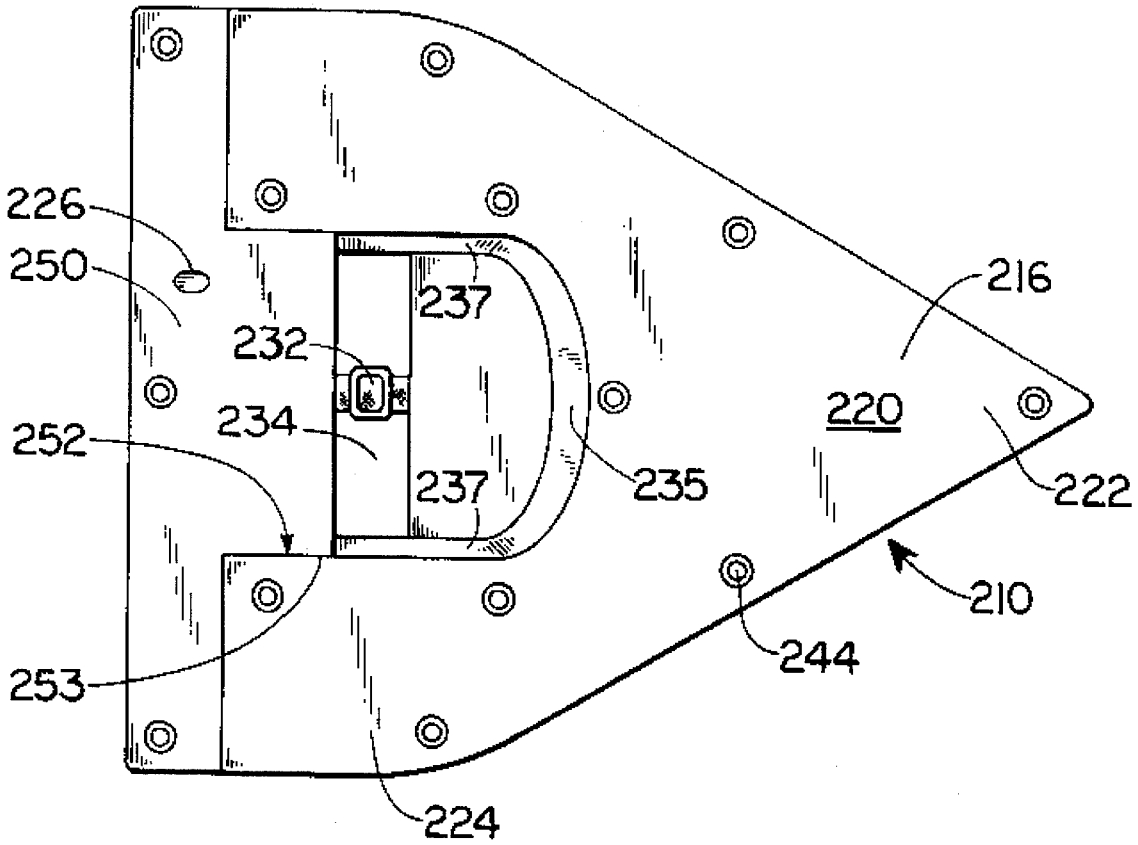
FIG. 4A is a top plan view of a second preferred embodiment of the invention, showing a removable T-shaped barrier.
Figure 4B:
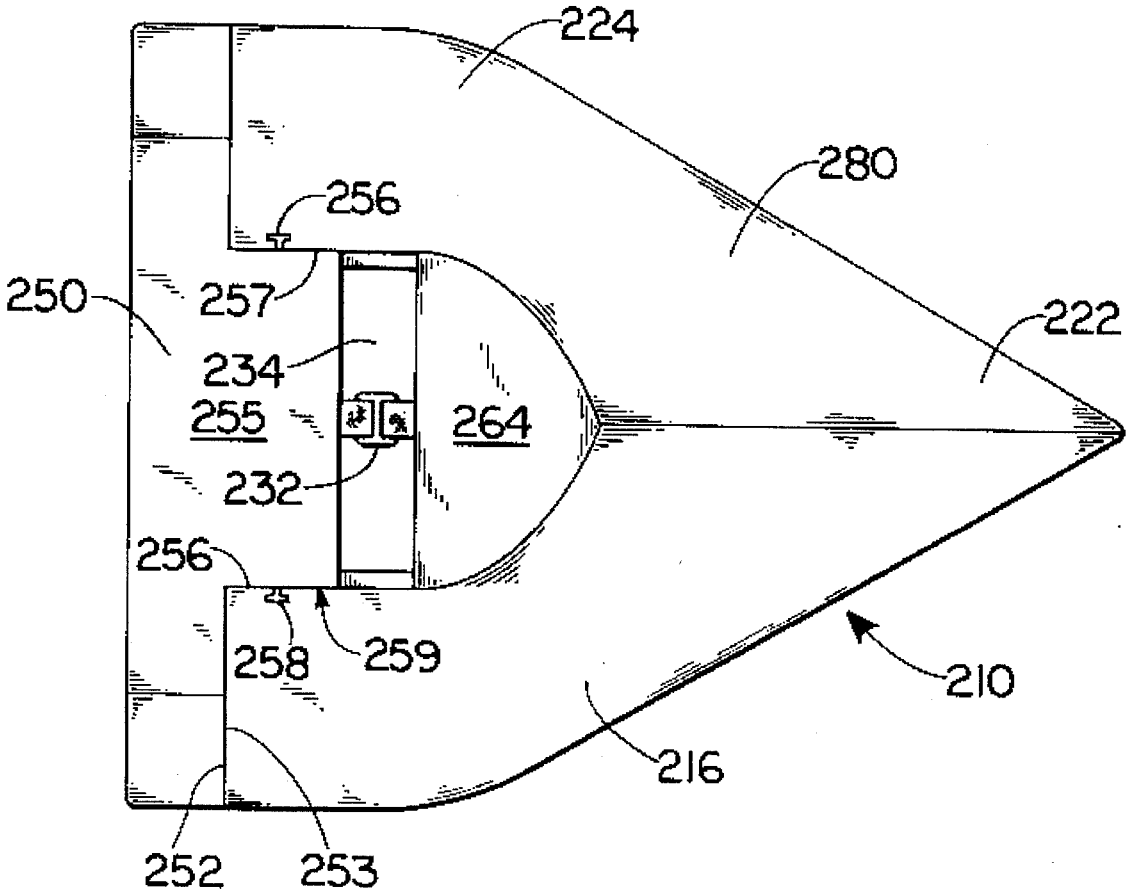
FIG. 4B is a bottom plan view of a second preferred embodiment of the invention, showing a removable T-shaped barrier.
Figure 4C:
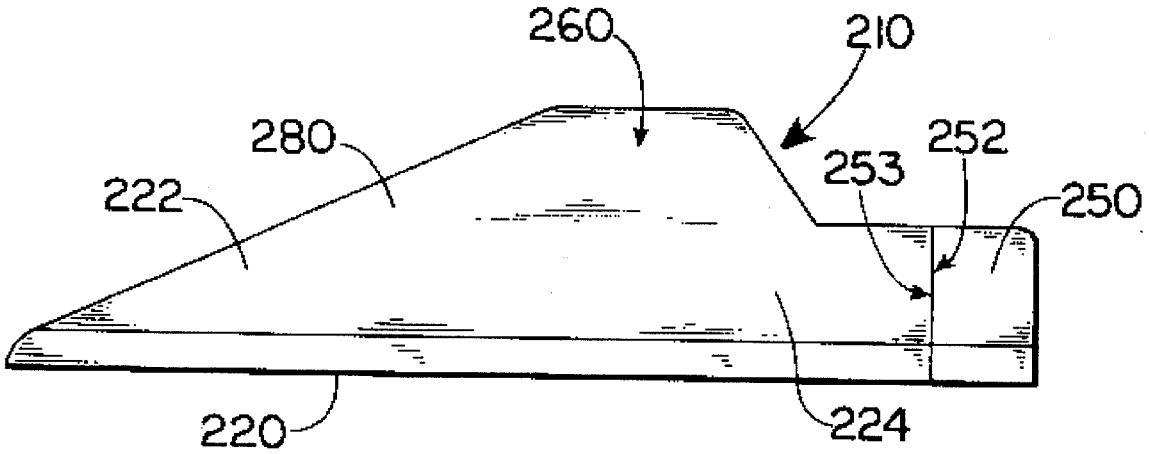
FIG. 4C is a side plan view of a second preferred embodiment of the invention.

With reference to FIGS. 4A and 4C, an opening 234 is defined through the hull 216. Below the upper surface 220 is a seating means for supporting the user, comprising a curved seat 230, a substantially vertical backrest 235, and side walls 237. A safety strap 232 is secured to the front edge of seat 230, and extends across opening 234 to a T-shaped barrier 250.

A plurality of attachment means 244 are situated about the perimeter of the upper surface 220 of hull 216. The attachment means 244 are used to secure interchangeable accessories (not shown) to the flotation device 210.

The bottom of the flotation device is shown in FIGS. 5B and 5C. The underside 280 curves downward from upper surface 220, forming an apex at the distal end of the bow 222. Full keel 260 projects downward from lower surface 280. Opening 234 in hull 216 is situated between the substantially horizontal bottom surface 264 of the keel 260, and the barrier 250.

Figure 4D:
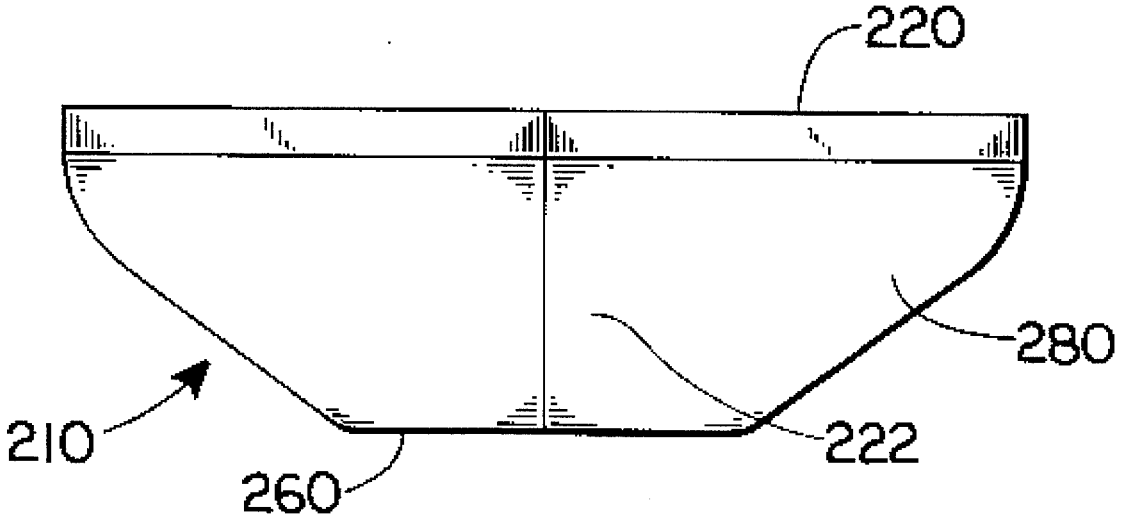
FIG. 4D is a front plan view of a second preferred embodiment of the invention.
Figure 4E:
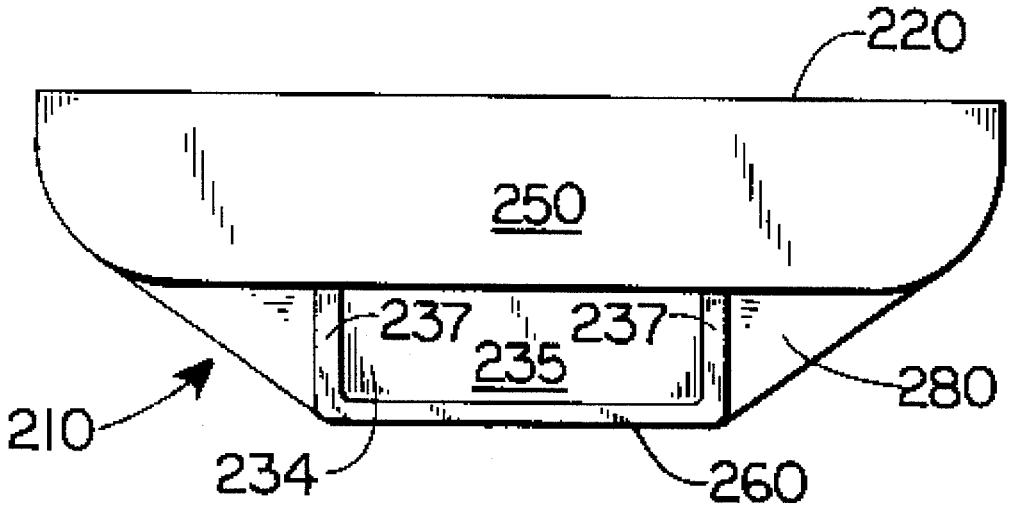
FIG. 4E is a back plan view of a second preferred embodiment of the invention.

FIG. 4D depicts the flotation device as viewed from the bow end. FIG. 4E depicts the flotation device as viewed from the stern end. Seat back 235 is shown as viewed through opening 234 in the hull 216.

Figure 4F:
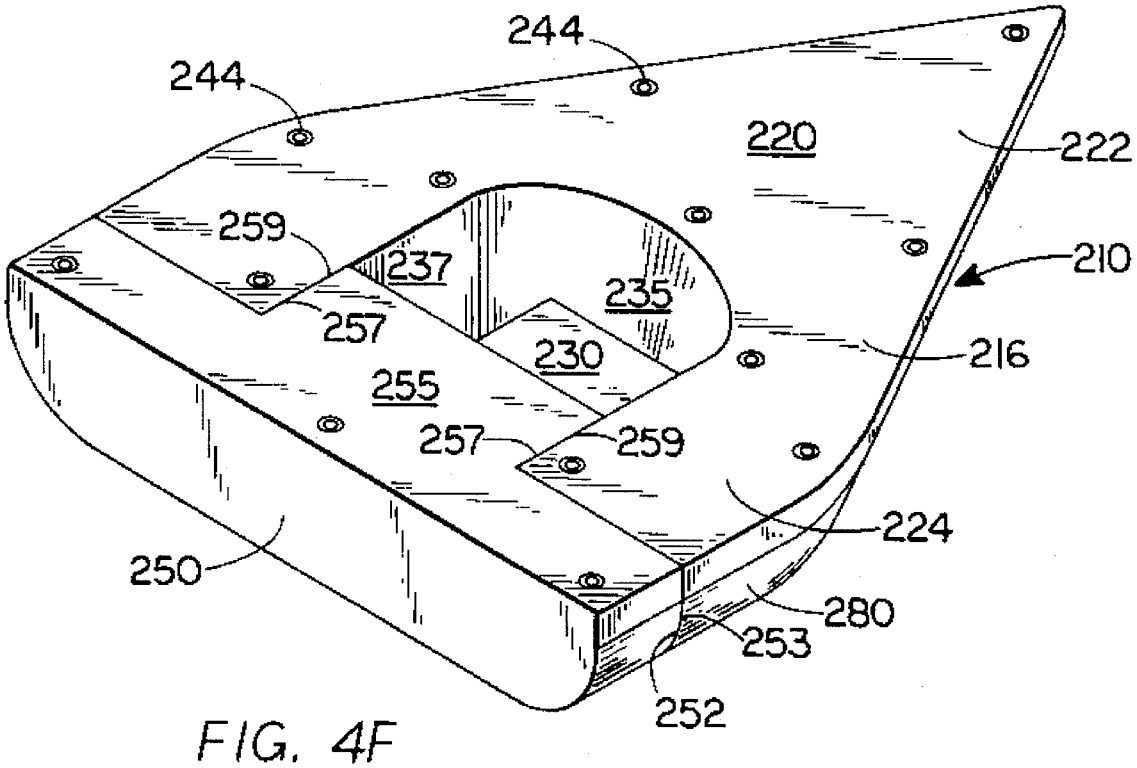
FIG. 4F is a perspective view of a second preferred embodiment of the invention, showing a removable T-shaped barrier.

FIG. 4F is a perspective view of the flotation device described in FIGS. 4A–4E.

Figure 5:
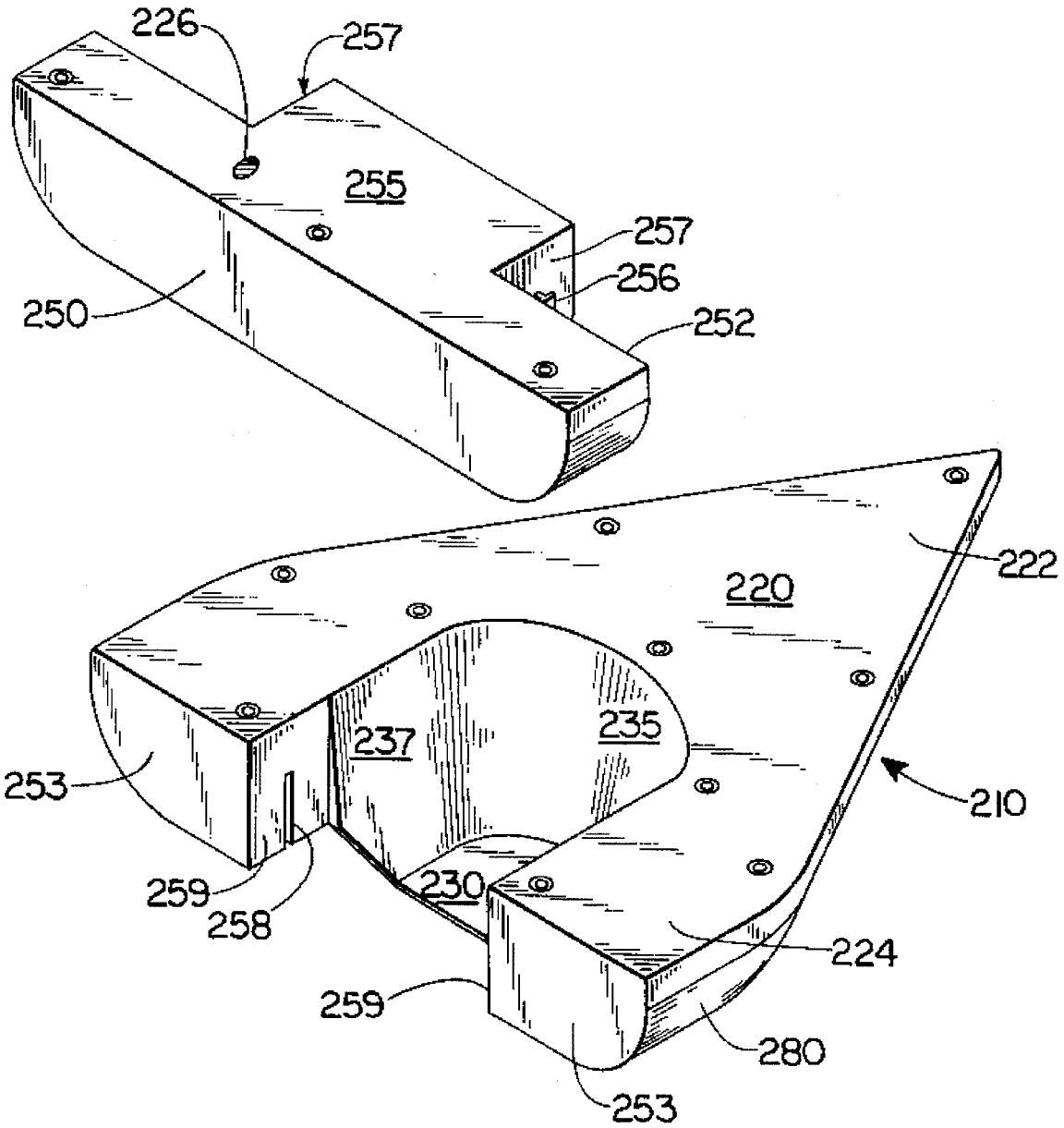
FIG. 5 is a perspective view of a second preferred embodiment of the invention, showing the T-shaped barrier removed from the body.

With specific reference to FIG. 5, the T-shaped barrier 250 has substantially vertical sides 257 and 252, which form a substantially 90° inside angle with each other. The flotation device 210 has substantially vertical walls 253 and 259, which form a substantially 90° outside angle with each other. The flotation device 210 slidably receives the T-shaped barrier 250 by sliding the T-shaped flanges 256 located on vertical sides 257 of barrier 250 into the T-shaped channels 258 located on inside walls 259 of the flotation device 210. Walls 259 are substantially perpendicular to upper surface 220 of flotation device 210, and complementary to the angle of sides 252 of barrier 250, such that when the barrier 250 is installed in the flotation device 210, side 257 is substantially adjacent to wall 259, and side 252 is adjacent to transom 253. Upper surface 255 of the barrier 250 is substantially horizontal.

An third preferred embodiment, is shown in FIGS. 6A, 6B, 6C, 6D, 6E, 6F and 7. This embodiment comprises of a flotation device 310 with a bow 322 and a stern 324, having a hull 316 with a substantially horizontal upper surface 320, a curved lower surface 380, and a keel 360 which extends downward frown lower surface 380. In this embodiment, a substantially rectangular removable barrier 350 is mounted to the transom 353 at the stern 324. The barrier 350 is slidably mounted to the transom 353 in the same manner as described above, and acts as the buoyant barrier in this third preferred embodiment.

Preferably a receptacle 326 is provided on rectangular barrier 350 for receiving the handle of a fishing rod (not shown).

Figure 6A:
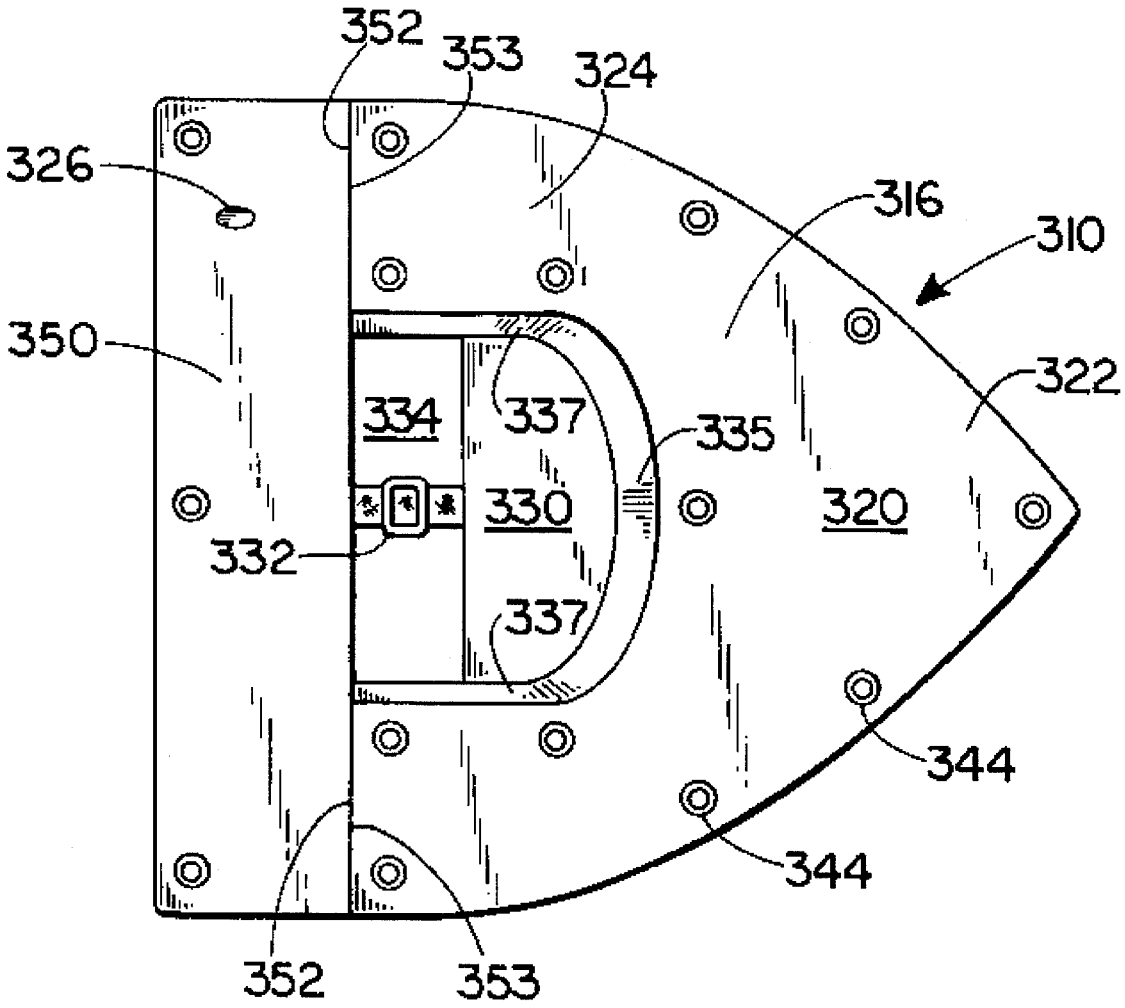
FIG. 6A is a top plan view of a third preferred embodiment of the invention, showing a removable rectangular barrier.
Figure 6B:
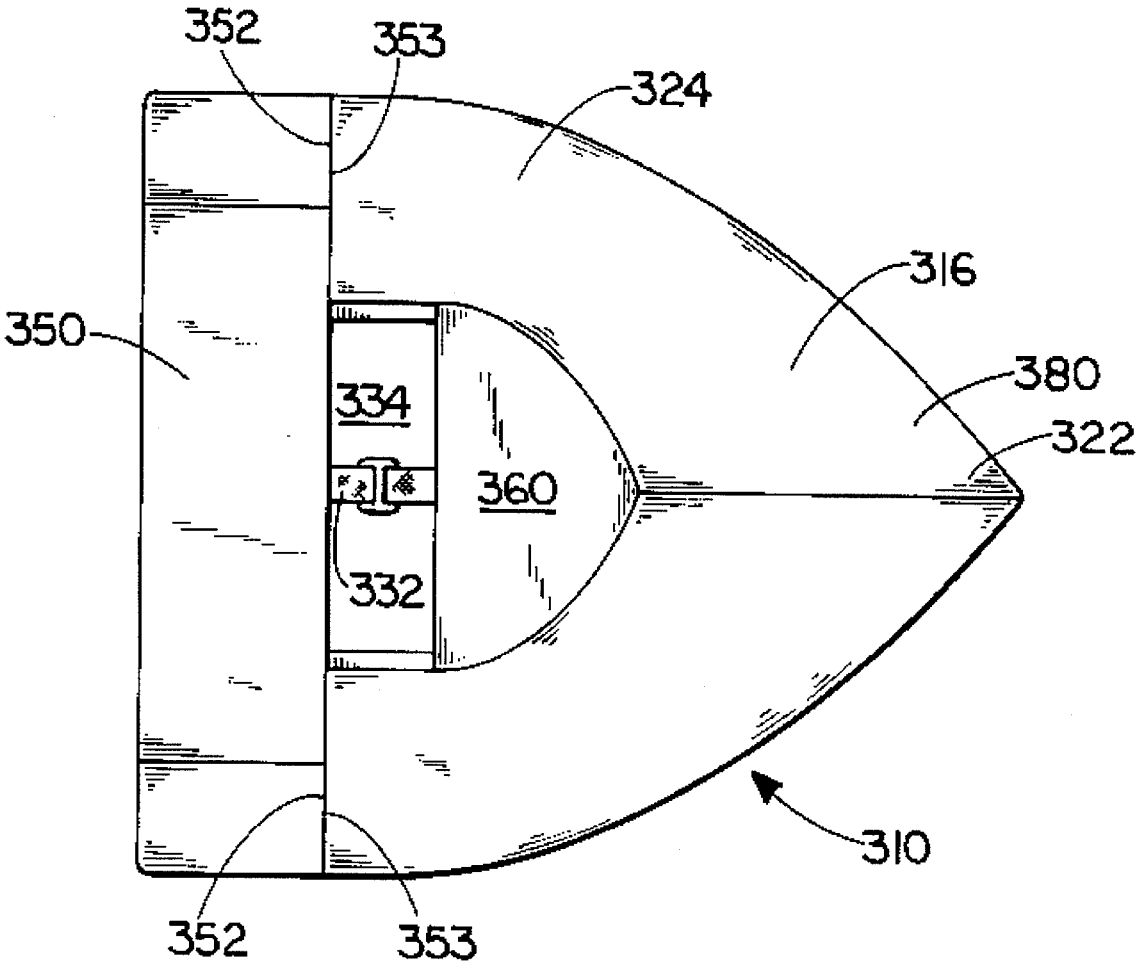
FIG. 6B is a bottom plan view of a third preferred embodiment of the invention, showing a removable rectangular barrier.
Figure 6C:
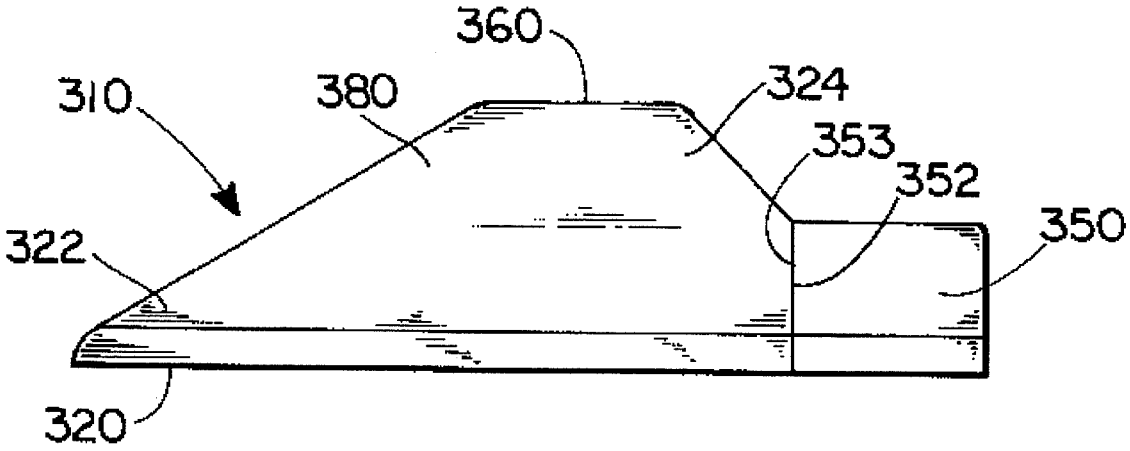
FIG. 6C is a side plan view of a third preferred embodiment of the invention.

With reference to FIGS. 6A and 6C, an opening 334 is defined through the hull 316. Below the upper surface 320 is a seating means for supporting the user, comprising a curved seat 330, a substantially vertical backrest 335, and side walls 337. A safety strap 332 is secured to the front edge of seat 330, and extends across opening 334 to an elongated rectangular barrier 350.

A plurality of attachment means 344 are situated about the perimeter of the upper surface 320 of hull 316. The attachment means 344 are used to secure interchangeable accessories (not shown) to the flotation device 310.

The bottom of the flotation device is shown in FIGS. 6B and 6C. The underside 380 curves downward from upper surface 320, forming an apex at the distal end of the bow 322. Full keel 360 projects downward from lower surface 380. Opening 334 in hull 316 is situated between the keel 360, and the barrier 350.

Figure 6D:
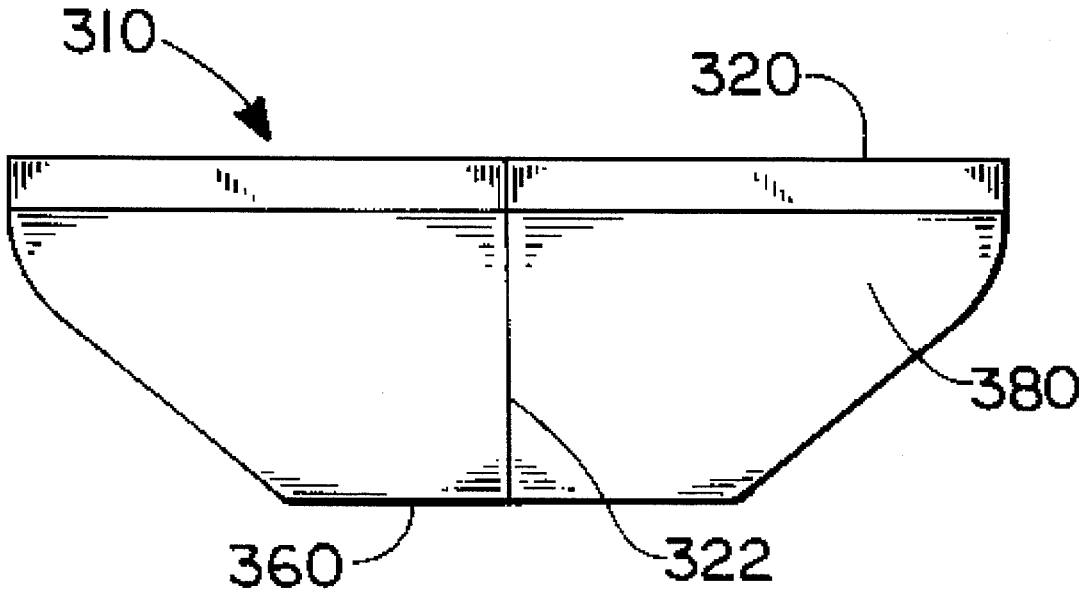
FIG. 6D is a front plan view of a third preferred embodiment of the invention.
Figure 6E:
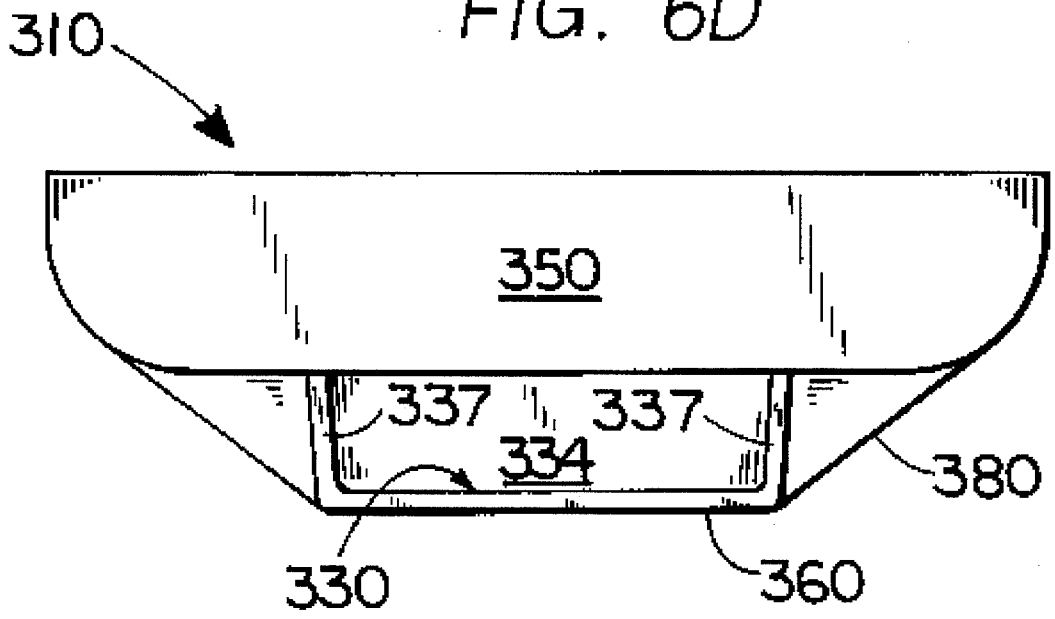
FIG. 6E is a back plan view of a third preferred embodiment of the invention.

FIG. 6D depicts the flotation device as viewed from the bow end. FIG. 6E depicts the flotation device as viewed from the stern end. Seat back 335 is shown as viewed through opening 334 in the hull 316.

Figure 6F:
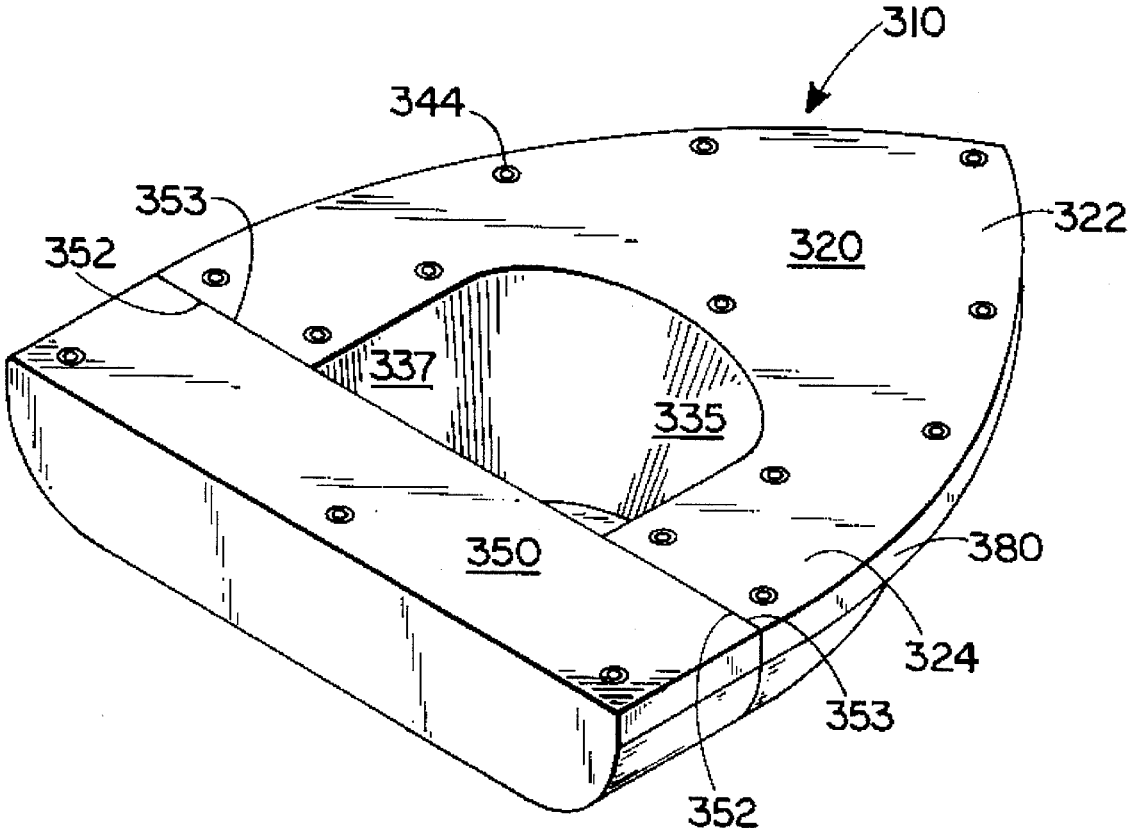
FIG. 6F is a perspective view of a third preferred embodiment of the invention, showing a removable rectangular barrier.

FIG. 6F is a perspective view of the flotation device described in FIGS. 6A–6E.

Figure 7:
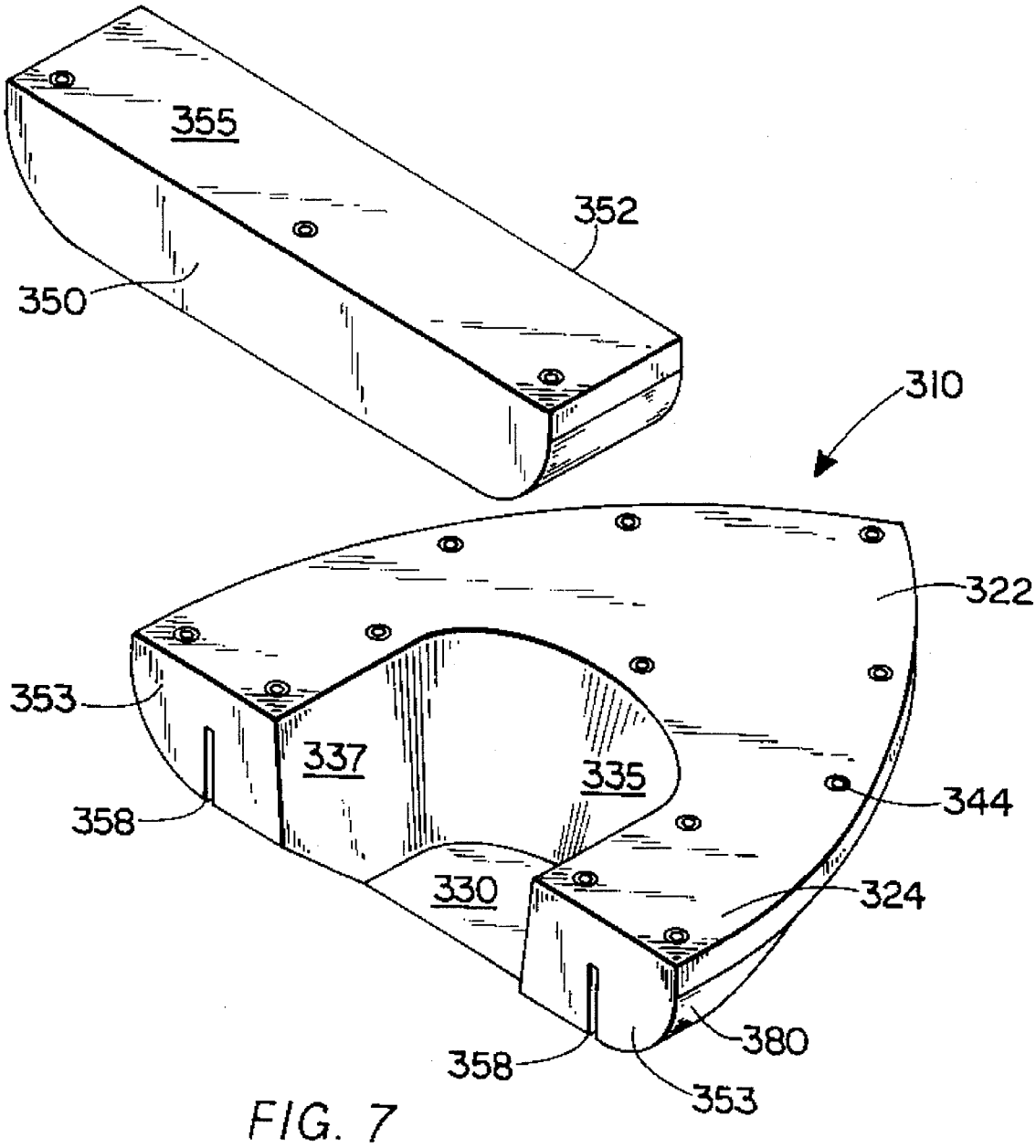
FIG. 7 is a perspective view of a third preferred embodiment of the invention, showing the rectangular barrier removed from the body.

With specific reference to FIG. 7, the rectangular barrier 350 has an elongated side 352 which is substantially perpendicular to its upper surface 355. The flotation device 310 slidably receives the barrier 350 by sliding the T-shaped flanges (not shown on FIG. 7; See FIG. 4, number 156) located on elongated side 352 into the T-shaped channel 358 located on the transom 353 of the flotation device 310. The transom 353 is substantially perpendicular to upper surface 320 of flotation device 310, and complementary to the angle of elongated side 352 of barrier 350, such that when the barrier 350 is installed in the flotation device 310, elongated side 352 is substantially adjacent to transom 353. Upper surface 355 of the barrier 350 is substantially horizontal.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principals of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims which follow.

I claim:

1. A buoyancy controlled aperture defined in a hull of a flotation device that is responsive to a loading and an unloading of the flotation device, the flotation device having an unloaded waterline and a loaded waterline vertically spaced above the unloaded waterline, the buoyancy controlled aperture comprising:

a buoyant barrier having a waterline; and means for mounting the barrier in the aperture for vertical sliding movement relative to the aperture between an open position when the flotation device is unloaded where the waterline of the barrier is even with the unloaded waterline of the flotation device and a closed position when the flotation device is loaded where the waterline of the barrier is even with the loaded waterline of the flotation device.

2. The buoyancy controlled aperture of claim 1 wherein the barrier has a first end and a second end opposed to the first end;

the aperture has a first inside wall and a second inside wall opposed to the first inside wall; and the mounting means comprises:

a first guide slot on the first end of the barrier;

a first guide member on the first inside wall of the aperture, the first guide member on the first inside wall slidingly received within the first guide slot on the first end of the barrier;

a second guide slot on the second end of the barrier; and a second guide member on the second inside wall of the aperture, the second guide member on the second inside wall slidingly received within the second guide slot on the second end of the barrier.

3. The buoyancy controlled aperture of claim 1 wherein the barrier has a first end and a second end opposed to the first end;

the aperture has a first inside wall and a second inside wall opposed to the first inside wall; and the mounting means comprises:

a first guide member on the first end of the barrier;

a first guide slot on the first inside wall of the aperture, the first guide member on the first end of the barrier slidingly received within the first guide slot on the first inside wall of the aperture;

a second guide member on the second end of the barrier; and a second guide slot on the second inside wall of the aperture, the second guide member on the second end of the barrier slidingly received within the second guide slot on the second inside wall of the aperture.

4. The buoyancy controlled aperture of claim 1 wherein the barrier has a substantially T-shaped cross-section, a first vertical side and a second vertical side opposed to the first vertical side;

the aperture has a first inside wall and a second inside wall opposed to the first inside wall; and the mounting means comprises:

a first guide slot on the first vertical side of the barrier;

a first guide member on the first inside wall of the aperture, the first guide member on the first inside wall slidingly received within the first guide slot on the first vertical side of the barrier;

a second guide slot on the second vertical side of the barrier; and a second guide member on the second inside wall of the aperture, the second guide member on the second inside wall slidingly received within the second guide slot on the second vertical side of the barrier.

5. The buoyancy controlled aperture of claim 1 wherein the barrier has a substantially T-shaped cross-section, a first vertical side and a second vertical side opposed to the first vertical side;

the aperture has a first inside wall and a second inside wall opposed to the first inside wall; and the mounting means comprises:

a first guide member on the first vertical side of the barrier;

a first guide slot on the first inside wall of the aperture, the first guide member on the first vertical of the barrier slidingly received within the first guide slot on the first inside wall of the aperture;

a second guide member on the second vertical side of the barrier; and a second guide slot on the second inside wall of the aperture, the second guide member on the second vertical side of the barrier slidingly received within the second guide slot on the second inside wall of the aperture.

6. The buoyancy controlled aperture of claim 1 wherein the flotation device has a transom;

the barrier has an elongated side; and the mounting means comprises:

at least a first guide slot on the transom of the flotation device; and at least a first guide member on the elongated side of the barrier, the first guide member slidingly received within the first guide slot.

7. The buoyancy controlled aperture of claim 1 wherein the flotation device has a transom;

the barrier has an elongated side; and the mounting means comprises:

at least a first guide member on the transom of the flotation device; and at least a first guide slot on the elongated side of the barrier, the first guide member slidingly received within the first guide slot.

8. An apparatus for opening aperture defined in a hull of a flotation device when the flotation device is in an unloaded condition and for closing the aperture when the flotation device is in a loaded condition, the flotation device having an unloaded waterline and a loaded waterline vertically spaced above the unloaded waterline, the buoyancy controlled aperture comprising:

a buoyant barrier having a waterline; and the barrier mounted across the aperture for vertical sliding movement relative to the aperture between an open position when the flotation device is unloaded where the waterline of the barrier is even with the unloaded waterline of the flotation device and a closed position when the flotation device is loaded where the waterline of the barrier is even with the loaded waterline of the flotation device.

* * * * *